US012535294B1

(12) United States Patent
Hiles

(10) Patent No.: US 12,535,294 B1
(45) Date of Patent: Jan. 27, 2026

(54) PRINTING PREVENTION SYSTEMS

(71) Applicant: Ronald James Hiles, San Antonio, TX (US)

(72) Inventor: Ronald James Hiles, San Antonio, TX (US)

( * ) Notice: Subject to any disclaimer, the term of this patent is extended or adjusted under 35 U.S.C. 154(b) by 138 days.

(21) Appl. No.: 18/364,309

(22) Filed: Aug. 2, 2023

Related U.S. Application Data

(60) Provisional application No. 63/370,490, filed on Aug. 4, 2022.

(51) Int. Cl.
*F41C 33/04* (2006.01)
*F41C 33/02* (2006.01)

(52) U.S. Cl.
CPC ..... *F41C 33/048* (2013.01); *F41C 33/0209* (2013.01)

(58) Field of Classification Search
CPC ..... F41C 33/048; F41C 33/0209
USPC ..... 224/911, 912, 192
See application file for complete search history.

(56) References Cited

U.S. PATENT DOCUMENTS

| | | | | |
|---|---|---|---|---|
| 5,054,670 | A | 10/1991 | Gallagher | |
| 5,265,781 | A | 11/1993 | Nichols | |
| D887,706 | S | 6/2020 | Evans | |
| D919,964 | S | 5/2021 | Evans | |
| 11,353,286 | B1 * | 6/2022 | Moultrie | F41C 33/0209 |
| 11,441,871 | B1 * | 9/2022 | Weber | F41C 33/048 |
| 2008/0105717 | A1 | 5/2008 | Hudson | |
| 2022/0011073 | A1 | 1/2022 | Clawson et al. | |
| 2022/0155042 | A1 | 5/2022 | Considine et al. | |

* cited by examiner

*Primary Examiner* — Corey N Skurdal
(74) *Attorney, Agent, or Firm* — Volk & McElroy, LLP; Michael D. Volk, Jr.

(57) ABSTRACT

A printing prevention system that utilizes a contact pad connected to a concealment wing for enhancing the concealment and use of a firearm in a holster. In one implementation, the apparatus comprises a body member of a concealment wing attachable to a holster and a removable contact pad attached to the body member. The contact pad comprises a waistband contact surface to leverage the pressure from the user's waistband to draw the grip of a firearm closer to the user's body and an angled ramp surface to assist positioning of the holster within a waistband or belt. The position of the contact pad may be adjustable relative to the body member so that the contact pad can stay in contact with the user's belt with a variety of different placements of the belt clip on the holster.

13 Claims, 8 Drawing Sheets

PRINTING PREVENTION SYSTEMS

CROSS-REFERENCE TO RELATED APPLICATION

The present application is related to and claims priority from prior provisional patent application Ser. No. 63/370,490, filed Aug. 4, 2022, titled "PRINTING PREVENTION SYSTEMS", the content of which is incorporated herein by this reference and is not admitted to be prior art with respect to the present disclosure by the mention in this cross-reference section.

DETAILED DESCRIPTION

Figure 1:
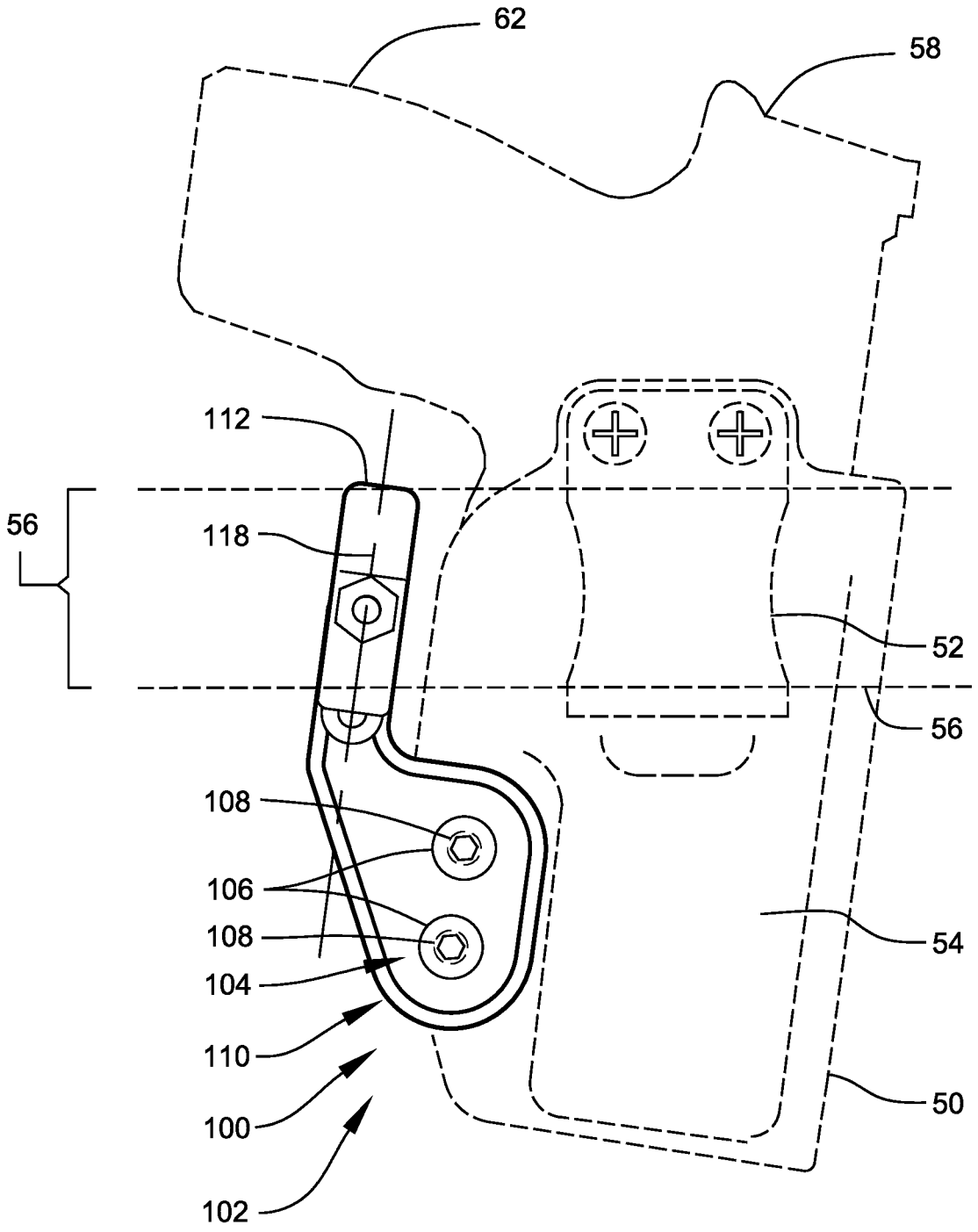
FIG. 1 shows a front elevational view illustrating a concealment wing and contact pad apparatus mounted to an inside-the-waistband holster according to an implementation of the present disclosure.

This disclosure relates to providing a system for improved concealed carrying of a small arm. More particularly this disclosure relates to enhancements that improve both the convenience of using an inside-the-waistband holster and the ability of such holsters to conceal the small arm within the user's clothing.

Carrying a concealed firearm requires a careful balance of accessibility, concealment, convenience, and safety. A significant challenge for concealed carry practitioners is keeping the grip of the firearm from printing or showing through the user's clothing, which can draw unwanted attention and potentially compromise the user's safety. The "printing" issue is particularly prevalent with larger firearms or when the user is wearing lighter, tighter, or less structured clothing.

Various solutions have been devised to address this issue. One common approach is to adjust the cant or angle of the firearm within the holster. While this may improve concealment, it can also compromise draw speed and the natural grip alignment. Another approach is to use holsters with extra padding or clothing layers to help break up the outline of the firearm, but these can add bulk and discomfort for the wearer.

Another solution that has emerged recently in the market is the use of a device often called a "holster claw" or "holster wing" or "concealment wing". This device protrudes from the holster and uses the pressure of the wearer's waistband to rotate the grip of the firearm towards the body, reducing the likelihood of the firearm printing. However, current iterations of these devices have certain limitations. They lack adjustability to accommodate different belt clip placements and are often difficult to position between the user's body and waistband. Many users have experienced the frustration of having a claw or wing snag on their waistband as the holster's belt clip is engaged over the waistband or belt.

A primary object and feature of the present disclosure is to provide a system overcoming the above-mentioned problems. It is a further object and feature of the present disclosure to provide such a system that facilitates the convenient and efficient placement of an inside-the-waistband holster within the user's waistband. It is another object and feature of the present disclosure to provide such a system that facilitates the concealed carrying of a small arm preventing visible "printing" of the weapon through the user's clothing. A further primary object and feature of the present disclosure is to provide such a system that is efficient, inexpensive, and useful. Other objects and features of this disclosure will become apparent with reference to the following descriptions.

In accordance with preferred implementations hereof, this disclosure describes an apparatus for use with a firearm holster, such firearm holster arranged to hold a firearm in an accessibly concealed position within a user's waistband, the apparatus comprising: a concealment wing comprising a body member having a first end, a second end, and a longitudinal axis passing through said second end, said longitudinal axis being offset from said first end, and said first end being structurally configured for attachment to the firearm holster; a contact pad removably attached to said second end of said body member of said concealment wing, said contact pad having a waistband contact surface oriented generally parallel to said longitudinal axis, said waistband contact surface structured and arranged to contact and press against an inside portion of the user's waistband when the firearm holster is in such accessibly concealed position, and a ramp surface oriented at an angle relative to said longitudinal axis, said ramp surface structured and arranged to assist mechanically-leveraged movement of said waistband contact surface into contact with such inside portion of the user's waistband during placement of the firearm in the accessibly concealed position; and said waistband contact surface of said contact pad leverages pressure from the user's waistband to press a grip portion of the firearm, held in the firearm holster, closer to the user, thereby aiding in concealment of the firearm. Even further it provides such an apparatus in which said ramp surface of said contact pad is oriented such that the distance from said ramp surface, relative to said longitudinal axis, decreases as said ramp surface approaches said first end. Still further, it provides such an apparatus in which said ramp surface of said contact pad oriented at an angle of about 36 degrees relative to said longitudinal axis. Even further, it provides such an apparatus in which said contact pad comprising an overall pad length of about 1.36 inches; and said waistband contact surface and said ramp surface each comprise about one half of said overall pad length. And further, it provides such an apparatus in which said contact pad comprising an overall pad width of about 0.45 inches. Still further, it provides such an apparatus in which said body member comprising a plurality of pad attachment points structurally configured to enable adjustment of the position of said contact pad along said longitudinal axis. Even further, it provides such an apparatus in which said plurality of pad attachment points comprise three pad attachment points. And further, it provides such an apparatus further comprising at least one pad-to-body fastener structurally configured to removably fasten said contact pad to said body member at said pad attachment points. Even further, it provides such a printing prevention system in which said at least one pad-to-body fastener comprising a threaded fastener assembly. And further, it provides such a printing prevention system in which said contact pad is attachable to said body member via at least one threaded fastener assembly. Even further, it provides such a printing prevention system in which said first end of said body member includes at least one attachment mechanism that is compatible with a variety of holster designs. And further, it provides such a system in which said first end of said body member is structurally configured to be attachable to the firearm holster utilizing at least one holster retention fastener of the firearm holster. Even further, it provides such a system in which said first end of said body member is structurally configured to be attachable to the firearm holster utilizing at least two holster retention fasteners of the firearm holster. And further, it provides such a system in which said body member further comprising a first body side and a second body side, said second body side opposing the first; an ambidextrous structural symmetry, said ambidextrous structural symmetry enabling attachment of either one of said first body side and said second body side to the firearm holster and enabling removable attachment of said contact pad to either one of said first body side and said second body side; and said concealment wing apparatus is structurally configured to be usable with the firearm holster worn in either one of a right-handed holster configuration or a left-handed holster configuration.

In accordance with another implementation hereof, this disclosure describes a printing prevention system for use with a firearm holster equipped with a concealment wing, such firearm holster structured and arranged to hold a firearm in an accessibly concealed position within a user's waistband, the printing prevention system comprising: at least one contact pad removably attachable to a concealment wing attachable to a firearm holster, the at least one contact pad comprising a concealment wing engaging rear end and an opposing front end; the opposing front end of the at least one contact pad comprising a ramp surface structured and arranged to assist mechanically-leveraged movement of a waistband contact surface into contact with such inside portion of the user's waistband during placement of the firearm in the accessibly concealed position, and the waistband contact surface structured and arranged to contact and press against an inside portion of the user's waistband when the firearm holster is in such accessibly concealed position, and the waistband contact surface leverages pressure from the user's waistband to press a grip portion of the firearm, held in the firearm holster, closer to the user's body, aiding in concealment of the firearm. Even further, it provides such a printing prevention system in which the ramp surface having an angle of about 36 degrees relative to a longitudinal axis of the waistband contact surface. And further, it provides such a printing prevention system in which the contact pad being adjustably positionable relative to the concealment wing. Even further, it provides such a printing prevention system in which, the concealment wing engaging rear end comprising at least two projecting posts to adjustably position the at least one contact pad relative to the concealment wing. And further, it provides such a printing prevention system in which the contact pad comprising at least one recessed socket structured and arranged to receive a fastener to secure the at least one contact pad to the concealment wing.

In accordance with another implementation hereof, this disclosure describes a method of enhancing firearm concealment with a firearm holster, the method comprising the steps of: connecting at least one contact pad to a concealment wing, the at least one contact pad comprising a waistband contact surface oriented generally parallel to the longitudinal axis, the waistband contact surface structured and arranged to contact and press against an inside portion of the user's waistband when the firearm holster is in an accessibly concealed position, and a ramp surface oriented at an angle relative to the longitudinal axis, the ramp surface structured and arranged to assist mechanically-leveraged movement of the waistband contact surface into contact with such inside portion of the user's waistband during placement of the firearm in the accessibly concealed position; connecting a contact pad and concealment wing assembly to a firearm holster; positioning a firearm within the firearm holster; and positioning the holster with the attached contact pad and concealment wing assembly such that the contact pad presses against the user's waistband, with the contact pad leveraging pressure from the user's waistband to press a grip of the firearm held in the firearm holster closer to the user's body, thereby aiding in the concealment of the firearm.

The various implementations of the present disclosure will hereinafter be described in conjunction with the appended drawings, wherein like designations denote like elements.

As discussed above, implementations of the present disclosure relate to holster accessories for enhancing the concealed carrying of a small arm (also referred to herein as a firearm) and more particularly to printing prevention systems as used to improve the concealment characteristics and functional convenience of inside-the-waistband holsters and similar concealment devices.

Generally, this disclosure describes a contact pad and concealment wing assembly for use with firearm holsters, particularly holsters of a type designed to hold a firearm in an accessibly concealed position within a user's waistband. The concealment wing of the present disclosure is arranged to allow for direct attachment of the wing to the firearm holster. When the concealment wing and the contact pad of the present disclosure are joined together, a portion of the contact pad connected to the concealment wing projects outwardly from the holster to engage and press firmly against the inside of the wearer's waistband during use. This interaction applies an opposing force on the firearm holster resulting in a rotation of the grip of the firearm towards the wearer's body. This effectively reduces the likelihood of the firearm visibly "printing" through the wearer's clothing.

In reference to the drawings, FIG. 1 shows a front elevational view illustrating concealment wing and contact pad apparatus 102 of printing prevention system 100 coupled to an inside-the-waistband firearm holster 50 according to a preferred implementation of the present disclosure. Inside-the-waistband firearm holster 50 (illustrated using dashed lines) may comprise a belt clip 52 and outer shell 54. Belt clip 52 is designed to engage the belt or waistband 56 of a piece of clothing (e.g., pants) of the user, as shown. Outer shell 54 of firearm holster 50 is adapted to receive and securely hold firearm 58 during use.

Concealment wing and contact pad apparatus 102 may be firmly attached to firearm holster 50 using one or more attachment mechanisms 104. Attachment mechanism 104 may comprise fastening hardware including bolts, screws, and the like. Implementations of the present disclosure may selectively configure attachment mechanism 104 to utilize fasteners specifically compatible with the holster on which the apparatus is being mounted thus making concealment wing and contact pad apparatus 102 readily adaptable to a variety of holster configurations. In the implementation of FIG. 1, concealment wing and contact pad apparatus 102 is mounted to firearm holster 50 using a set of adjustable retention screws 106 engaged in the factory retention screw mounting points 108 of outer shell 54, as shown. Inside-the-waistband firearm holsters 50 of the type formed from semi-rigid polymers (e.g., Kydex©, etc.), often utilize adjustable retention screws 106, allowing the user to tighten or loosen the holster's grip on the firearm. Utilizing these factory retention screw mounting points 108 enables concealment wing apparatus and contact pad apparatus 102 to be securely mounted to firearm holster 50 without special modifications to the holster assembly. Upon reading this specification, it should be appreciated that, under appropriate circumstances, considering such issues as user preferences, design preference, structural requirements, cost, holster configuration, etc., other mounting arrangements such as, for example, providing instructions for modifying an existing holster not having factory retention screw mounting points, providing an adapter to adapt the apparatus to a non-conforming holster, etc., may suffice.

Figure 2:
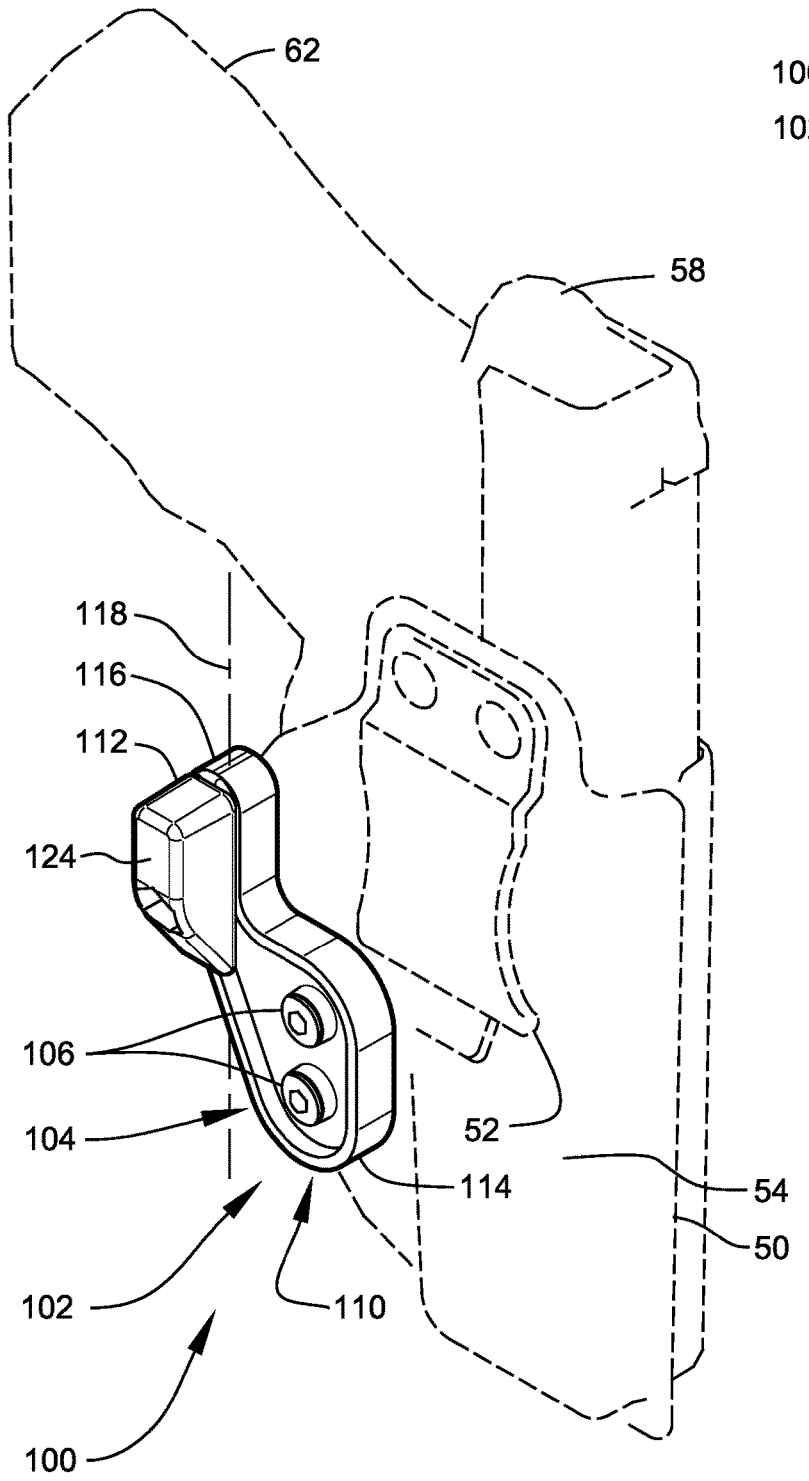
FIG. 2 shows a front perspective view illustrating the concealment wing and contact pad apparatus of FIG. 1 mounted to the inside-the-waistband holster.
Figure 3:
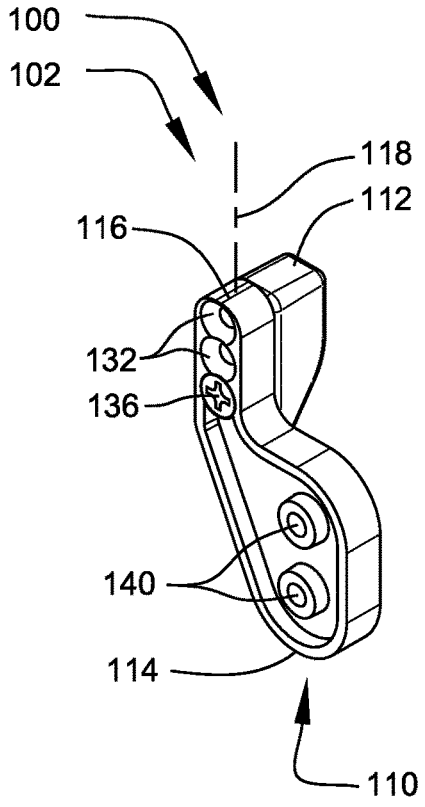
FIG. 3 shows a rear perspective view illustrating the concealment wing and contact pad apparatus of FIG. 1.

FIG. 2 shows a front perspective view illustrating the concealment wing and contact pad apparatus of FIG. 1 mounted to inside-the-waistband holster 50. FIG. 3 shows a rear perspective view illustrating concealment wing and contact pad apparatus 102 of FIG. 1 separated from inside-the-waistband holster 50. Referring to FIGS. 2 and 3, concealment wing and contact pad apparatus 102 comprises a body member 110 and waistband contact pad 112 removably coupled to body member 110. Body member 110 comprises first end 114, second end 116, and a longitudinal axis 118 passing through second end 116 in an arrangement laterally offset from first end 114, as shown. In the implementation of FIG. 1, first end 114 is structurally configured to be attachable to firearm holster 50 using attachment mechanism 104, as described above. Second end 116 of body member 110 may be configured to support waistband contact pad 112 in a position locating contact pad 112 at the level of the user's waistband 56 (see FIG. 1).

Figure 4:
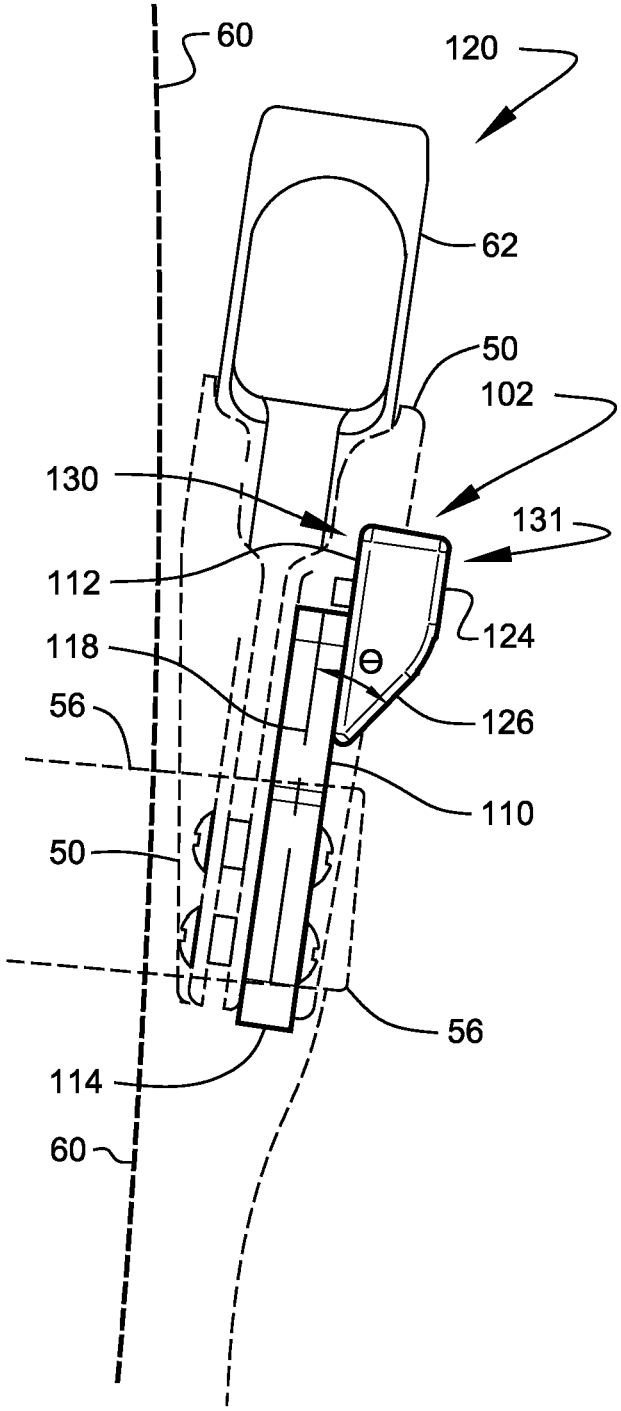
FIG. 4 shows a diagrammatic side view of the inside-the-waistband holster with the concealment wing and contact pad apparatus being moved to a concealed position within the user's waistband, according to an implementation of the present disclosure.
Figure 5:
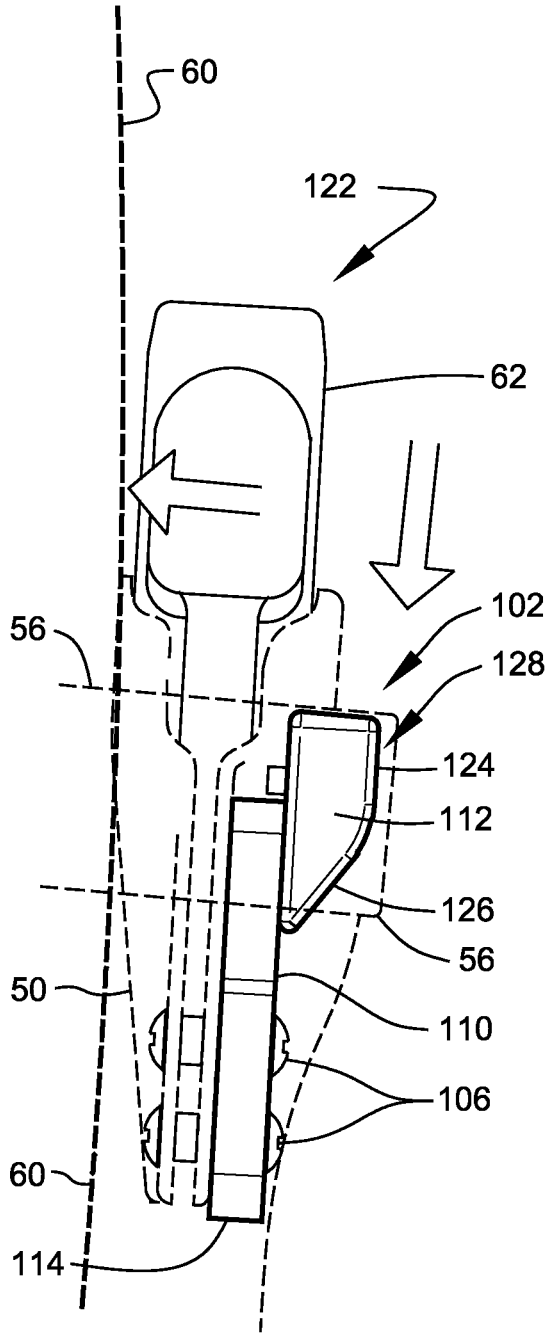
FIG. 5 shows a second diagrammatic side view of the inside-the-waistband holster with the concealment wing and contact pad apparatus located in the concealed position within the user's waistband, according to an implementation of the present disclosure.
Figure 6:
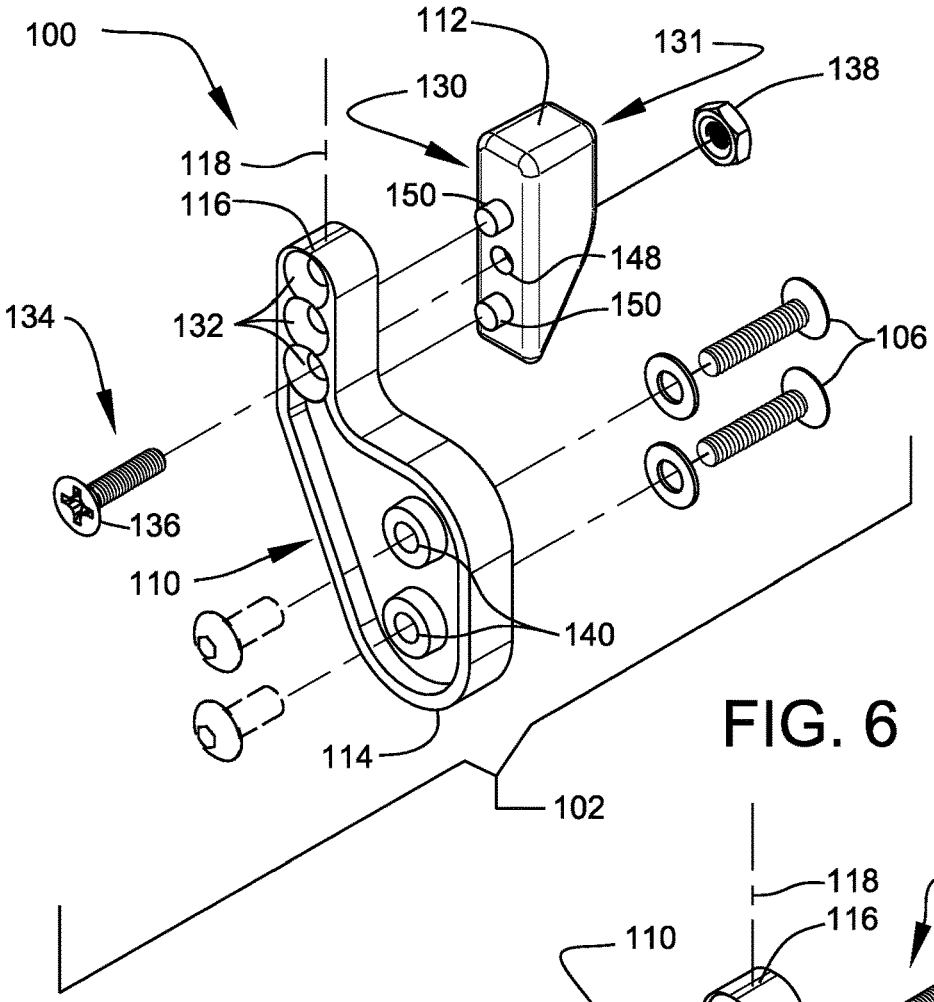
FIG. 6 shows a front exploded view of the concealment wing and contact pad apparatus of FIG. 1.

FIG. 4 shows a diagrammatic side view of concealment wing and contact pad apparatus 102 joined to inside-the-waistband holster 50 before the assembly is lowered from starting position 120 to an accessibly concealed position 122 within the user's waistband 56, according to an implementation of the present disclosure. FIG. 5 shows a second diagrammatic side view, showing inside-the-waistband holster 50 and concealment wing and contact pad apparatus 102 lowered to the accessibly concealed position 122 within the user's waistband 56, according to an implementation of the present disclosure. Contact pad 112 comprises concealment wing engaging rear end 130 (which may also be referred to as body member engaging rear end) and an opposing front end 131. Front end 131 includes waistband contact surface 124, oriented generally parallel to longitudinal axis 118, and ramp surface 126, oriented at an angle relative to longitudinal axis 118. Waistband contact surface 124 is structured and arranged to contact and press against an inside portion of the user's waistband 56 when firearm holster 50 is placed in the accessibly concealed position 122 within waistband 56. Ramp surface 126 of front end 131 is oriented such that the distance from ramp surface 126, relative to longitudinal axis 118, decreases as ramp surface 126 approaches first end 114 of body member 110. Thus, ramp surface 126 imparts a wedge shape to contact pad 112, as shown. This tapering profile is highly useful in reducing snagging of the apparatus on the user's waistband 56 as firearm 58 is placed in the accessibly concealed position. Furthermore, the wedge shape of contact pad 112 reduces the applied force needed to execute a smooth downward movement of the holster assembly, thereby enhancing the convenience of placing waistband contact surface 124 in the position of contact 128 within the user's waistband 56. Without the ramp feature of the present disclosure, a user would require additional lifting and aligning of the waistband to situate the holster assembly behind waistband 56, which would likely require cumbersome manipulations using both hands of the user 60 to execute.

In operation, the input force (in this case the force exerted by user 60 on the firearm and firearm holster 50) is converted by ramp surface 126 into a separating force that acts between waistband 56 and the body of user 60. When the thin edge of the wedge-shaped contact pad 112 is engaged between these surfaces and a downward force is applied, the force is divided over a reduced contact area, thus increasing the applied pressure and facilitating separation of the adjacent surfaces. The angle of ramp surface 126 determines how much force amplification occurs. In the implementation of the present disclosure, ramp surface 126 comprises an angle $\theta$ of about 36 degrees relative to longitudinal axis 118. Angle $\theta$ was found to be effective in providing a significantly beneficial level of mechanical leverage during movement of waistband contact surface 124 into the position of contact 128 with the user's waistband 56 during placement of firearm 58 in the accessibly concealed position.

With specific reference to FIG. 5, when inside-the-waistband holster 50 is situated within the user's waistband 56, waistband contact surface 124 of contact pad 112 leverages pressure from waistband 56 to press a grip portion 62 of firearm 58 (held in firearm holster 50) closer to the body of user 60, thereby aiding in concealment of firearm 58, as shown. Although concealment wing and contact pad apparatus 102 is shown mounted to the outer face of outer shell 54, concealment wing and contact pad apparatus 102 may be mounted on the inner side of the shell or between the shell halves, as selected by the user to provide the best balance between concealment and comfort.

Figure 7:
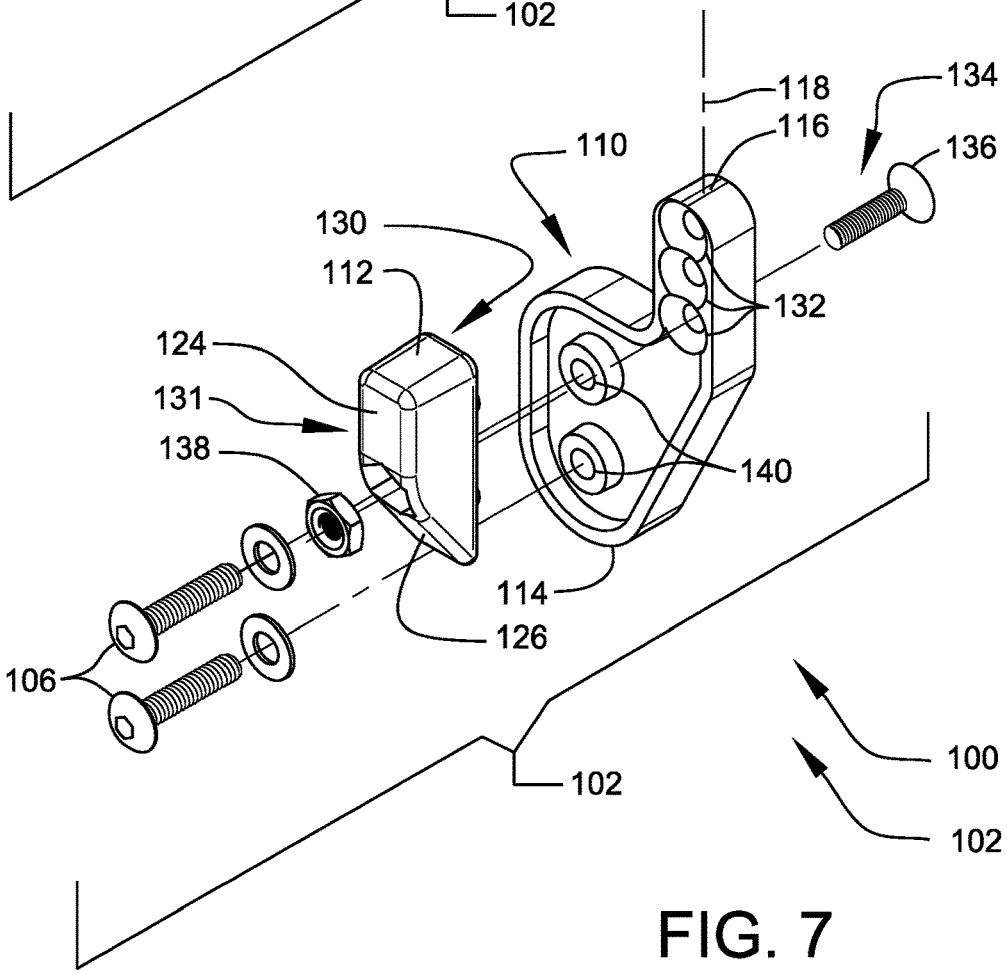
FIG. 7 shows a rear exploded view of the concealment wing and contact pad apparatus of FIG. 1.
Figure 8:
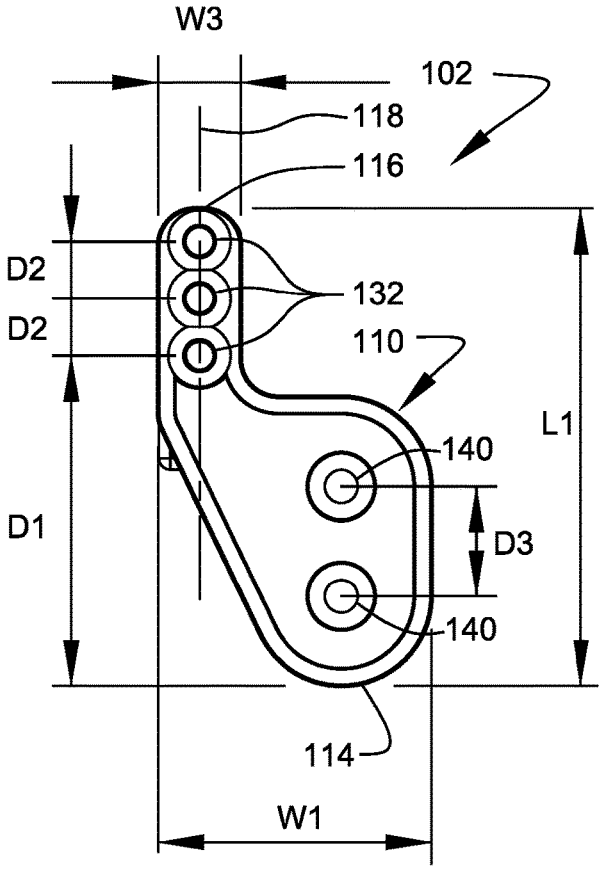
FIG. 8 shows a rear elevational view of the concealment wing and contact pad apparatus of FIG. 1.
Figure 9:
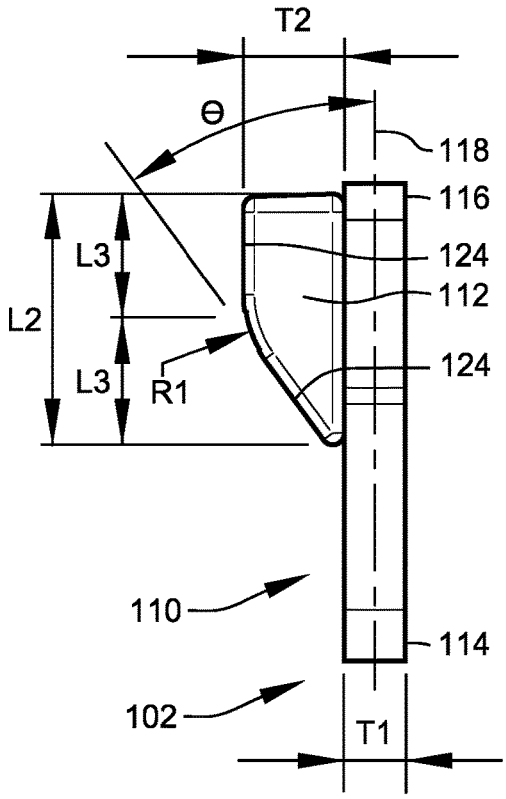
FIG. 9 shows a side elevational view of the concealment wing and contact pad apparatus of FIG. 1.
Figure 10:
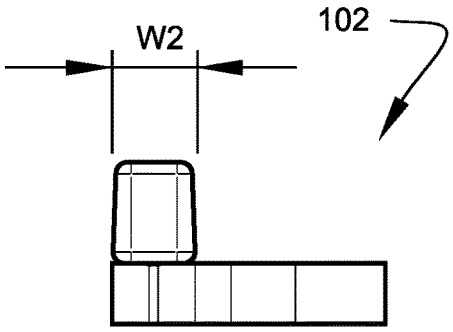
FIG. 10 shows a top view of the concealment wing and contact pad apparatus of FIG. 1.

Referring to FIGS. 6 through 10, FIG. 6 shows a front exploded view of concealment wing and contact pad apparatus 102 of FIG. 1. FIG. 7 shows a rear exploded view of concealment wing and contact pad apparatus 102 of FIG. 1. FIG. 8 shows a rear elevational view of concealment wing and contact pad apparatus 102 of FIG. 1. FIG. 9 shows a side elevational view of concealment wing and contact pad apparatus 102, according to the preferred implementation of FIG. 1. FIG. 10 shows a top view of concealment wing and contact pad apparatus 102, according to the preferred implementation of FIG. 1.

As above, body member 110 includes first end 114, second end 116, and longitudinal axis 118 passing through second end 116 and offset from first end 114. According to one implementation of the present disclosure, body member 110 has a length L1 of about 2.6 inches, a width W1 of about 1.5 inches and a thickness T1 of about 0.3 inch. According to one implementation of the present disclosure, contact pad 112 comprises an overall pad length L2 of about 1.36 inches and an overall pad thickness T2 of about 0.45 inches and an overall width W2 of about 0.44 inch. According to one implementation of the present disclosure, waistband contact surface 124 and ramp surface 126 each comprise a length L3 equaling about one half of overall pad length L2, as shown. The intersection of waistband contact surface 124 and ramp surface 126 may comprise a smooth transition having a radius R1 of about 0.6 inch. According to one implementation of the present disclosure, second end 116 of body member 110 comprises a width W3 of about 0.45 inch. Second end 116 is structurally arranged to place contact pad 112 in adjacent proximity with waistband 56 when inside-the-waistband holster 50 is situated within the user's waistband 56 (see, e.g., FIG. 1).

Implementations of the present disclosure may comprise a means for adjusting the mounting position of contact pad 112 along longitudinal axis 118. The adjustability is provided to accommodate different placements of belt clip 52. For example, if belt clip 52 is placed higher or lower, or the angle of the clip is changed, contact pad 112 may not initially align with the user's waistband 56. The ability to move contact pad 112 up and down longitudinal axis 118 allows contact pad 112 to be adjusted to a position of contact waistband 56 over a range of belt clip placements. Furthermore, it is advantageous for the position of the contact pad to be adjustable so that contact pad 112 can stay in contact with waistband 56 with a variety of different placements of the belt clip on the holster, thus accommodating differing holster configurations, holster carry positions, clothing types, etc.

To achieve the above-described adjustability, body member 110 may include a plurality of pad attachment points 132 structurally configured to enable adjustment of the position of contact pad 112 along longitudinal axis 118, as best illustrated in FIG. 8. In the implementation of FIG. 1, body member 110 comprises three pad attachment points 132, thus enabling contact pad 112 to be located at three different positions along longitudinal axis 118. In the implementation of FIG. 1, the pad attachment point 132 nearest first end 114 is spaced apart from first end 114 a distance D1 of about 1.8 inches. In one implementation, each pad attachment point 132 is separated from the adjacent pad attachment point 132 by a distance D2 of about 0.31 inches. Upon reading this specification, it should be appreciated that, under appropriate circumstances, considering such issues as user preferences, design preference, structural requirements, marketing preferences, cost, intended use, etc., other pad attachment arrangements such as, for example, alternate spacings, inclusion of more or fewer attachment points, implementing the pad and body member as a unitary structure, a sliding and locking mechanism, etc., may suffice.

At least one pad-to-body fastener 134 is provided and structurally configured to removably fasten contact pad 112 to second end 116 of body member 110 at a selected one of such pad attachment points 132. Pad-to-body fastener 134 may comprise a threaded fastener assembly consisting of a counter-sunk type machine screw 136 and corresponding threaded nut 138, as shown. In one implementation of the present disclosure, each pad attachment point 132 comprises an aperture passing through second end 116 of body member 110. Each side of such aperture may include a recessed conical shape to accommodate the head of the counter-sunk type machine screw 136, as shown.

Concealment wing and contact pad apparatus 102 is mounted to firearm holster 50 using a set of adjustable retention screws 106 engaged in the factory retention screw mounting points 108 of outer shell 54 (see FIG. 1). Such retention screws 106 may comprise low-profile "Chicago" type screws and corresponding sleeve nuts, as shown. In the example implementation of the present disclosure, first end 114 of body member 110 comprises two retention screw apertures 140 structurally configured to receive two retention screws 106, as shown. The retention screw apertures 140 may be surrounded by thickened bosses to support and facilitate tightening of retention screws 106. Retention screw apertures 140 may comprise a center-to-center distance D3 of about 0.6 inches (15 mm). The distance D3 corresponds to the industry standard hole spacing for retention hardware adopted by many firearm holster manufacturers. Those with ordinary skill in the art will now appreciate that upon reading this specification and by their understanding of the art of concealed holster design as described herein, methods of implementing such retention hardware will be understood by those knowledgeable in such art.

Figure 11:
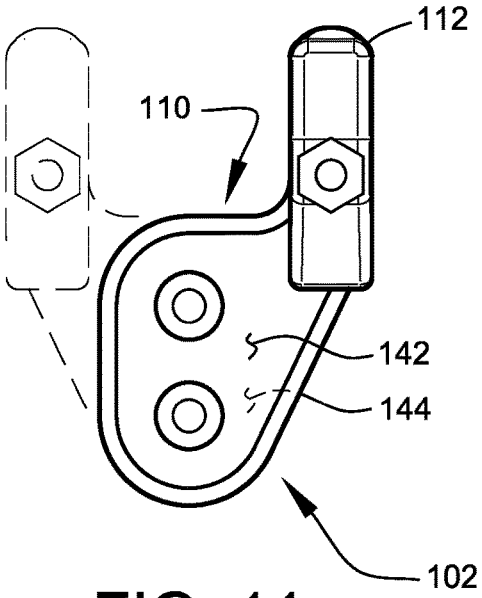
FIG. 11 shows a front elevational view illustrating the ambidextrous structural symmetry of the concealment wing and contact pad apparatus of FIG. 1.

FIG. 11 shows a front elevational view illustrating the ambidextrous structural symmetry of concealment wing and contact pad apparatus 102, according to an implementation of FIG. 1. Body member 110 of concealment wing and contact pad apparatus 102 may further comprise a first body side 142 and second body side 144, such second body side 144 opposing the first (see also FIG. 14). First body side 142 and second body side 144 may comprise an ambidextrous structural symmetry, meaning, both sides of body member 110 are geometrically identical, (apart from being mirrored). Such ambidextrous structural symmetry enables attachment of either one of such first body side 142 or second body side 144 to firearm holster 50 and enabling removable attachment of contact pad 112 to either one of such first body side 142 or second body side 144. Thus, concealment wing and contact pad apparatus 102 is structurally configured to be usable with firearm holster 50 worn in either of a right-handed holster configuration or a left-handed holster configuration. With this ambidextrous structural symmetry, concealment wing and contact pad apparatus 102 provides equal functionality and comfort to both right-handed carry and left-handed carry users. The example implementation of the present disclosure thus eliminates the need for distinct left-handed and right-handed versions of the apparatus, simplifying manufacturing and inventory management.

In some implementations, contact pad 112 may be offered without the specific body member 110 (which also may be referred to herein as a concealment wing). If a user already owns a concealment wing, contact pad 112 may be added to their already owned concealment wing to add the additional features that contact pad 112 provides.

Figure 12:
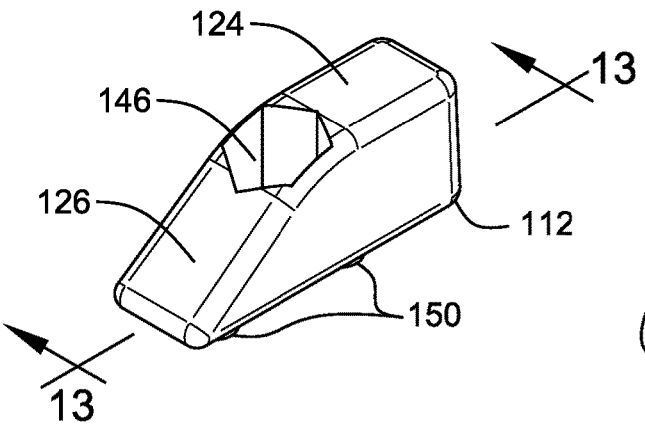
FIG. 12 shows a perspective view illustrating a contact pad according to an implementation of the present disclosure.

FIG. 12 shows a perspective view illustrating contact pad 112 of FIG. 1. As noted above, contact pad 112 comprises concealment wing engaging rear end 130 and an opposing front end 131. Front end 131 includes waistband contact surface 124 and ramp surface 126. In the illustrated implementation of the present disclosure, waistband contact surface 124 comprises a smooth planar surface, as shown. Upon reading this specification, it should be appreciated that, under appropriate circumstances, considering such issues as user preferences, design preference, structural requirements, cost, etc., other pad arrangements such as, for example, including ridges, bumps, knurling, or similar friction-enhancing surface features, providing a second ramp surface to assist holster removal, etc., may be sufficient.

Figure 13:
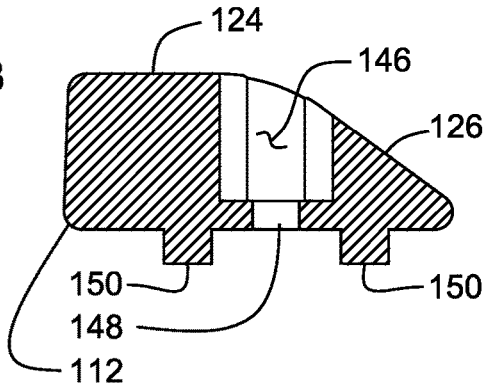
FIG. 13 shows the sectional view 13-13 of FIG. 12 illustrating internal features of the contact pad of FIG. 12.

FIG. 13 shows the sectional view 13-13 of FIG. 12 illustrating internal features of contact pad 112 of FIG. 12. Contact pad 112 may comprise a recessed socket 146 structurally adapted to receive threaded nut 138 of pad-to-body fastener 134 and a through-passage 148 suitably dimensioned to receive the shank of counter-sunk type machine screw 136.

In the assembly of contact pad 112 to second end 116, counter-sunk type machine screw 136 may be passed through a selected one of the pad attachment points 132 to engage through-passage 148 of the contact pad 112 and threaded nut 138. Recessed socket 146 may have a hexagonal shape configured to prevent rotation of threaded nut 138, thus facilitating the tightening of counter-sunk type machine screw 136 when bringing the two components together. Pad-to-body fastener 134, when tightened, secures the contact pad 112 to the pad attachment point 132, while also allowing for adjustable positioning of the two parts relative to one another.

Concealment wing engaging rear end 130 of contact pad 112 may further comprise a set of outwardly projecting posts 150, as shown. Projecting posts 150 are situated in a pattern that allows one or more of the posts to engage pad attachment point 132 of second end 116. In the assembly of contact pad 112 with second end 116, one or both of the two projecting posts of the contact pad 112 are aligned and engaged with the apertures of the pad attachment point 132. This arrangement of the present disclosure provides a strong and secure connection between contact pad 112 and second end 116, while also allowing for adjustability.

Figure 14:
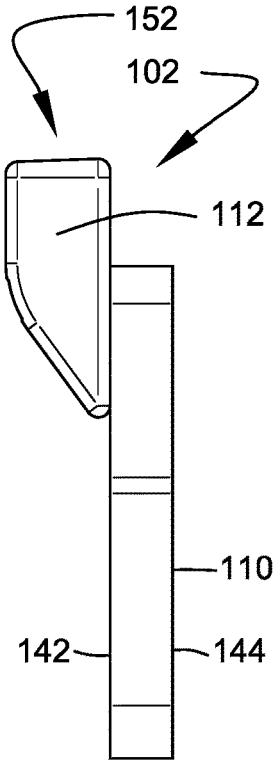
FIG. 14 shows a side elevational view illustrating the contact pad of FIG. 12 adjusted to a first operable position, according to an implementation of the present disclosure.
Figure 15:
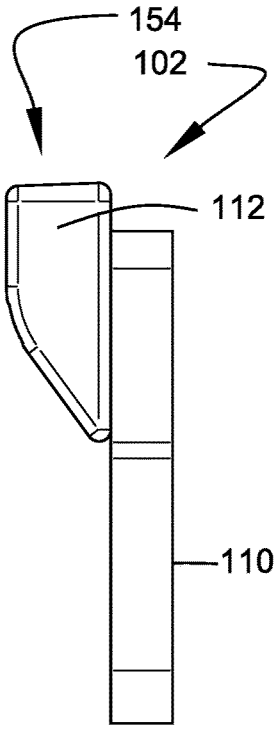
FIG. 15 shows a side elevational view illustrating the contact pad of FIG. 12 adjusted to a second operable position, according to an implementation of the present disclosure.
Figure 16:
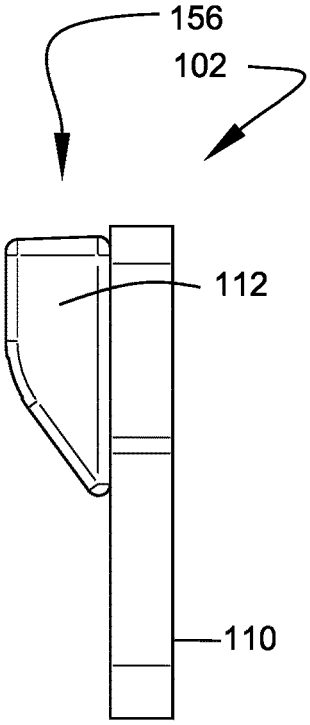
FIG. 16 shows a side elevational view illustrating the contact pad of FIG. 12 adjusted to a third operable position, according to an implementation of the present disclosure.

Referring to FIGS. 14 through 16 showing the adjustability of the example implementation, FIG. 14 shows a side elevational view illustrating contact pad 112 adjusted to first operable position 152, according to an implementation of the present disclosure. FIG. 15 shows a side elevational view illustrating contact pad 112 adjusted to a second operable position 154, according to an implementation of the present disclosure. FIG. 16 shows a side elevational view illustrating contact pad 112 adjusted to a third operable position 156, according to an implementation of the present disclosure. As noted above, the positional adjustability of contact pad 112 is useful in accommodating a variety of different placements of the belt clip on the holster along with differing body sizes, clothing styles, and holster carry preferences. Advantageously, the inherent adjustability of contact pad 112 allows the presently disclosed implementation to be configured for and worn by a variety of users and concealed carry positions.

Body member 110 and contact pad 112 of concealment wing and contact pad apparatus 102 may be composed of a wide range of durable and cost-effective materials. For example, body member 110 may be constructed from steel, aluminum, plastic, carbon fiber, and composites thereof. Contact pad 112 may be steel, aluminum, plastic, rubber, carbon fiber, and composites thereof.

The above-described components of concealment wing and contact pad apparatus 102 may be formed using at least one injection molding process. Those with ordinary skill in the art of injection molding processes will now appreciate that upon reading this specification and by their understanding of the apparatus as described herein, methods of implementing by injection molding such components of contact pad 112 and body member 110 will be understood by those knowledgeable in such art. Furthermore, components of contact pad 112 and body member 110 may comprise one or more selected colors. Such color may be imparted to the apparatus using dyes, coatings, and similar well-known means. Upon reading this specification, it should be appreciated that, under appropriate circumstances, considering such issues as user preferences, design preferences, structural requirements, marketing preferences, cost, available materials, technological advances, etc., other material arrangements may suffice.

Figure 17:
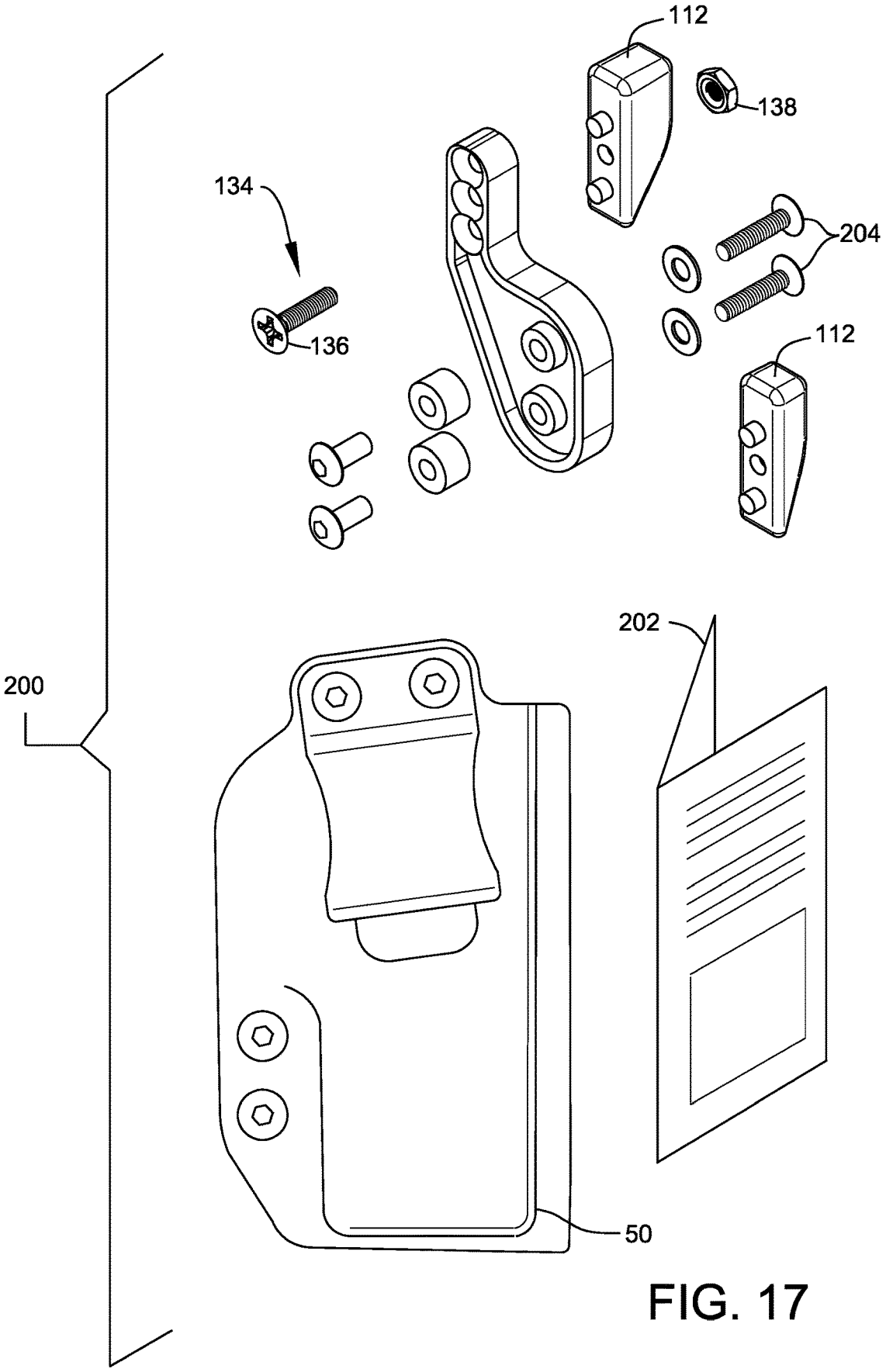
FIG. 17 shows a perspective view illustrating a kit containing components of the concealment wing apparatus, according to an implementation of the present disclosure.

FIG. 17 shows a perspective view illustrating a kit containing components of concealment wing apparatus 102, according to an implementation of the present disclosure. According to one implementation, concealment wing and contact pad apparatus 102 of printing prevention system 100 may be arranged as a kit 200. Kit 200 may include at least one body member 110, at least one contact pad 112, and combinations of the above-described apparatus fastening hardware. Even further, implementations of kit 200 may include at least one holster retention fastener of extended length 204 to accommodate the added thickness of body member 110. Moreover, implementations of kit 200 may include firearm holster 50. In particular, concealment wing and contact pad apparatus 102 may include a set of instructions 202. Instructions 202 may detail functional relationships in relation to the structure of the concealment wing and contact pad apparatus 102 (such that concealment wing and contact pad apparatus 102 can be used, maintained, or the like, in a preferred manner). Upon reading this specification, it should be appreciated that, under appropriate circumstances, considering such issues as user preferences, marketing preferences, cost, holster type, technological advances, etc., other kit arrangements such as, for example the inclusion of additional fasteners, spacers, retention hardware, adapters to accommodate special holster configurations, etc., may be sufficient.

Figure 18:
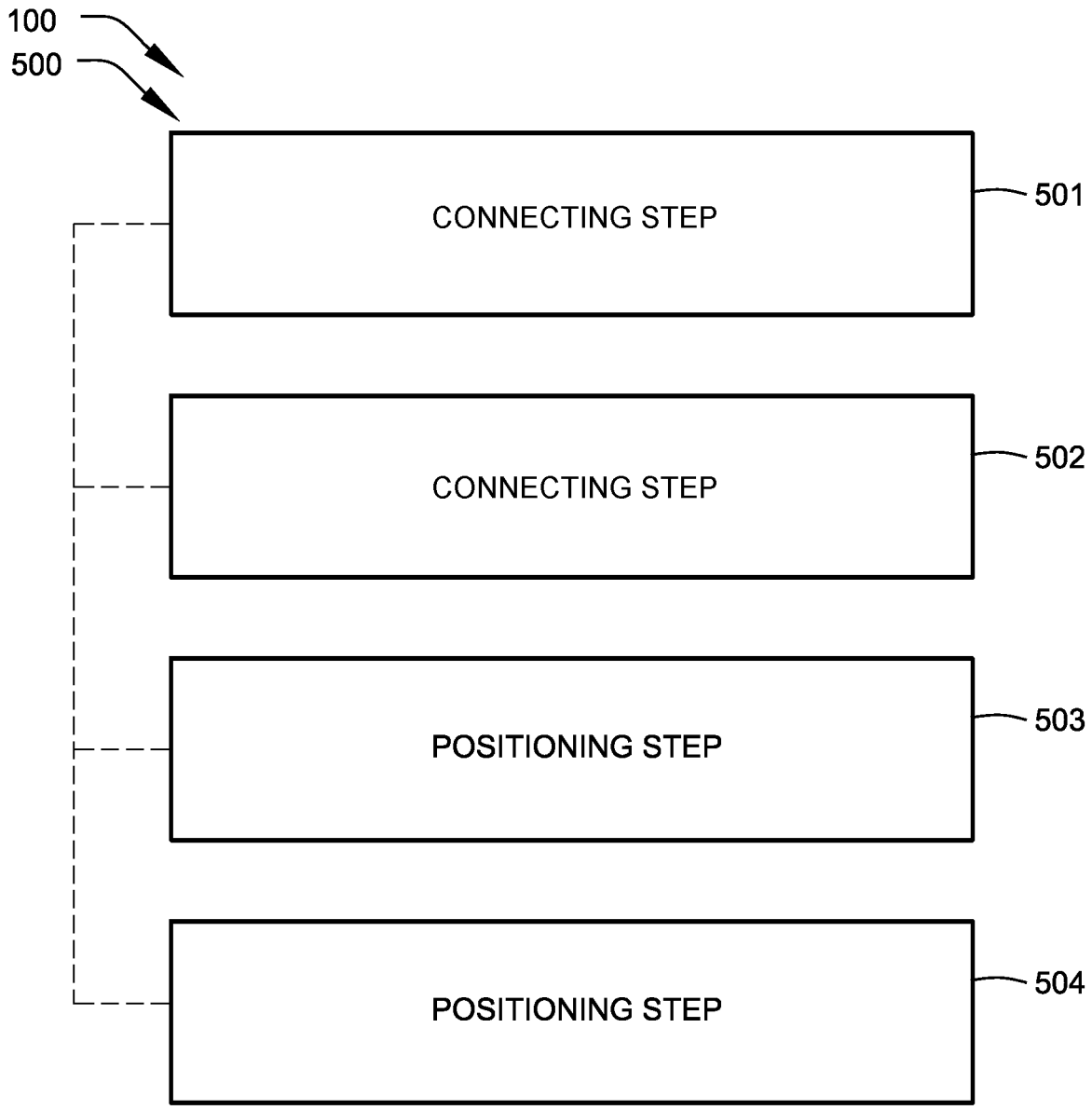
FIG. 18 is a flow diagram illustrating the steps of a method reducing the printing of a concealed firearm using the concealment wing apparatus, according to an implementation of the present disclosure.

FIG. 18 is a flow diagram illustrating the steps of method 500 of using concealment wing and contact pad apparatus 102 to enhance the concealment of firearm 58 held within firearm holster 50, according to an implementation of the present disclosure. As illustrated, method 500 may include the steps of: step one 501, connecting at least one contact pad (contact pad 112) to a concealment wing (body member 110), the at least one contact pad comprising a waistband contact surface oriented generally parallel to the longitudinal axis, the waistband contact surface structured and arranged to contact and press against an inside portion of the user's waistband when the firearm holster is in an accessibly concealed position, and a ramp surface oriented at an angle relative to the longitudinal axis, the ramp surface structured and arranged to assist mechanically-leveraged movement of the waistband contact surface into contact with such inside portion of the user's waistband during placement of the firearm in the accessibly concealed position; step two 502, connecting a contact pad and concealment wing assembly (concealment wing and contact pad apparatus 102) to a firearm holster; step three 503, positioning a firearm within the firearm holster; and step four 504, positioning the holster with the attached contact pad and concealment wing assembly such that the contact pad presses against the user's waistband, with the contact pad leveraging pressure from the user's waistband to press a grip of the firearm held in the firearm holster closer to the user's body, thereby aiding in the concealment of the firearm.

Although applicant has described applicant's implementations of this disclosure, it will be understood that the broadest scope of this disclosure includes modifications such as diverse shapes, sizes, and materials. Such scope is limited only by the below claims as read in connection with the above specification. Further, many other advantages of applicant's disclosure will be apparent to those skilled in the art from the above descriptions and the below claims.

What is claimed is:

1. An apparatus for use with a firearm holster, such firearm holster arranged to hold a firearm in an accessibly concealed position within a user's waistband, the apparatus comprising:

a contact pad;

a concealment wing comprising a body member having a first end configured to attach to the firearm holster, a second end having a plurality of linearly arranged apertures, and a longitudinal axis passing through said second end, said longitudinal axis being offset from said first end;

said contact pad comprising a concealment wing engaging rear end and an opposing front end;

said concealment wing engaging rear end comprising a flat rear mounting surface, a pair of proiecting posts extending outwardly from said flat rear mounting surface, and a passage opening positioned between said pair of projecting posts and extending through to a corresponding opening on said opposing front end, said pair of projecting posts configured to selectively engage with at least one of said plurality of linearly arranged apertures on said second end of said concealment wing to enable multiple distinct user-selected mounting positions of said contact pad on said concealment wing;

said opposing front end comprising a waistband contact surface oriented generally parallel to said longitudinal axis, said waistband contact surface structured and arranged to contact and press against an inside portion of the user's waistband when the firearm holster is in such accessibly concealed position, a ramp surface oriented at an angle relative to said longitudinal axis, said ramp surface structured and arranged to assist mechanically-leveraged movement of said waistband contact surface into contact with such inside portion of the user's waistband during placement of the firearm in the accessibly concealed position, and said waistband contact surface of said contact pad leverages pressure from the user's waistband to press a grip portion of the firearm, held in the firearm holster, closer to the user, thereby aiding in concealment of the firearm.

2. The apparatus of claim 1, said ramp surface of said contact pad is oriented such that the distance from said ramp surface, relative to said longitudinal axis, decreases as said ramp surface approaches said first end.

3. The apparatus of claim 1, further comprising at least one pad-to-body fastener passing through one of said plurality of linearly arranged apertures and said passage opening positioned between said pair of projecting posts and extending through to said corresponding opening on said opposing front end, said pad-to-body fastener configured to secure said contact pad to said body member in a user-selected mounting position while allowing removal and repositioning of said contact pad to different mounting positions.

4. The apparatus of claim 3, said at least one pad-to-body fastener comprising a threaded fastener assembly.

5. The apparatus of claim 3, said multiple distinct user-selectable mounting positions comprise two categories of mounting configurations, a first mounting configuration in which both projecting posts of said pair of projecting posts are inserted into corresponding apertures of said plurality of linearly arranged apertures and a second mounting configuration in which only one projecting posts of said pair of projecting posts is inserted into one of said plurality of linearly arranged apertures while the other projecting post remains disengaged.

6. The apparatus of claim 5, said recessed socket and said passage opening are configured to receive said at least one pad-to-body fastener in both said first mounting configuration and said second mounting configuration to secure said contact pad to said concealment wing.

7. The apparatus of claim 1, said first end of said body member includes at least one attachment mechanism that is compatible with a variety of holster designs.

8. The apparatus of claim 1, said first end of said body member is structurally configured to be attachable to the firearm holster utilizing at least one holster retention fastener of the firearm holster.

9. The apparatus of claim 1, said first end of said body member is structurally configured to be attachable to the firearm holster utilizing at least two holster retention fasteners of the firearm holster.

10. The apparatus of claim 1, said body member further comprising a first body side and a second body side, said second body side opposing the first; an ambidextrous structural symmetry, said ambidextrous structural symmetry enabling attachment of either one of said first body side and said second body side to the firearm holster and enabling removable attachment of said contact pad to either one of said first body side and said second body side; and said concealment wing apparatus is structurally configured to be usable with the firearm holster worn in either one of a right-handed holster configuration or a left-handed holster configuration.

11. The apparatus of claim 1, said multiple distinct user-selectable mounting positions comprise two categories of mounting configurations, a first mounting configuration in which both projecting posts of said pair of projecting posts are inserted into corresponding apertures of said plurality of linearly arranged apertures and a second mounting configuration in which only one projecting posts of said pair of projecting posts is inserted into one of said plurality of linearly arranged apertures while the other projecting post remains disengaged.

12. A printing prevention system for use with a firearm holster equipped with a concealment wing, such firearm holster structured and arranged to hold a firearm in an accessibly concealed position within a user's waistband, the printing prevention system comprising:

at least one contact pad removably attachable to a concealment wing attachable to a firearm holster, the at least one contact pad comprising a concealment wing engaging rear end having a pair of proiecting posts and a recessed socket positioned between said pair of projecting posts, said pair of projecting posts configured to adjustably position said at least one contact pad relative to the concealment wing, said recessed socket structured and arranged to receive a fastener to secure said at least one contact pad to the concealment wing;

and an opposing front end comprising a ramp surface structured and arranged to assist mechanically-leveraged movement of a waistband contact surface into contact with such inside portion of the user's waistband during placement of the firearm in the accessibly concealed position, and the waistband contact surface structured and arranged to contact and press against an inside portion of the user's waistband when the firearm holster is in such accessibly concealed position, and said contact pad is adjustably positionable relative to the concealment wing by selective engagement of at least one of said pair of projecting posts with the concealment wing; and the waistband contact surface leverages pressure from the user's waistband to press a grip portion of the firearm, held in the firearm holster, closer a to the user's body, aiding in concealment of the firearm.

13. A method of enhancing firearm concealment with a firearm holster, comprising:

selecting one of two mounting configuration types for mounting a contact pad to a concealment wing, the concealment wing having a plurality of linearly arranged apertures, the contact pad having a pair of projecting posts and a passage opening positioned between the pair of projecting posts, a waistband contact surface configured to contact an inside portion of a user's waistband, and a ramp surface configured to convert downward insertion force into a separating force between the user's waistband and body during holster placement;

a first mounting configuration type comprises inserting both projecting posts of the pair of projecting posts into corresponding apertures of the plurality of linearly arranged apertures, and a second mounting configuration type comprises inserting only one projecting post of the pair of projecting posts into one of the plurality of linearly arranged apertures while leaving the other projecting post disengaged;

connecting the contact pad to the concealment wing according to the selected mounting configuration type;

inserting a fastener through the passage opening and through one of the plurality of linearly arranged apertures positioned between the apertures containing both projecting posts when using the first mounting configuration type, and adjacent to the aperture containing the one projecting post when using the second mounting configuration type, to secure the contact pad to the concealment wing;

connecting the concealment wing with the connected contact pad to the firearm holster;

positioning the firearm within the firearm holster; and positioning the firearm holster with the attached contact pad and concealment wing assembly such that the contact pad presses against the user's waistband to press a grip of the firearm held in the firearm holster closer to the user's body, thereby aiding in the concealment of the firearm.

* * * * *